US008338689B1

(12) United States Patent
Beaty

(10) Patent No.: US 8,338,689 B1
(45) **Date of Patent: *Dec. 25, 2012**

(54) ELECTRIC INSTRUMENT MUSIC CONTROL DEVICE WITH MULTI-AXIS POSITION SENSORS

(75) Inventor: David W. Beaty, Mesa, AZ (US)

(73) Assignee: Telonics Pro Audio LLC, Mesa, AZ (US)

( * ) Notice: Subject to any disclaimer, the term of this patent is extended or adjusted under 35 U.S.C. 154(b) by 87 days.

This patent is subject to a terminal disclaimer.

(21) Appl. No.: 12/868,572

(22) Filed: Aug. 25, 2010

Related U.S. Application Data

(63) Continuation-in-part of application No. 12/253,852, filed on Oct. 17, 2008, now Pat. No. 7,923,623.

(51) Int. Cl.
*G10H 1/32* (2006.01)
*G10H 3/00* (2006.01)

(52) U.S. Cl. ..... 84/746; 84/718; 84/721; 84/743

(58) Field of Classification Search ..... None
See application file for complete search history.

(56) References Cited

U.S. PATENT DOCUMENTS

| | | | |
|---|---|---|---|
| 4,932,261 | A | 6/1990 | Henrion |
| 5,345,824 | A | 9/1994 | Sherman et al. |
| 5,392,650 | A | 2/1995 | O'Brien et al. |
| 5,540,095 | A | 7/1996 | Sherman et al. |
| 5,635,739 | A | 6/1997 | Grieff et al. |
| 5,835,077 | A | 11/1998 | Dao et al. |
| 5,962,784 | A | 10/1999 | Hulsing, II |
| 5,974,879 | A | 11/1999 | Hulsing, II |
| 5,992,233 | A | 11/1999 | Clark |
| 6,295,870 | B1 | 10/2001 | Hulsing, II |
| 6,463,802 | B2 | 10/2002 | Hulsing, II |
| 6,474,160 | B1 | 11/2002 | Stewart et al. |
| 6,516,283 | B2 | 2/2003 | McCall et al. |
| 6,522,992 | B1 | 2/2003 | McCall et al. |
| 6,557,415 | B2 | 5/2003 | Stewart et al. |
| 6,701,788 | B2 | 3/2004 | Babala |
| 6,703,939 | B2 | 3/2004 | Lehrman et al. |
| 6,713,829 | B1 | 3/2004 | Karpman |
| 6,725,719 | B2 | 4/2004 | Cardarelli |
| 6,765,489 | B1 | 7/2004 | Ketelhohn |
| 6,843,126 | B2 | 1/2005 | Hulsing, II |
| 6,848,304 | B2 | 2/2005 | Geen |
| 6,868,726 | B2 | 3/2005 | Lemkin et al. |
| 6,925,876 | B2 | 8/2005 | Babala |
| 7,069,785 | B2 | 7/2006 | Chou |
| 7,095,331 | B2 | 8/2006 | Lehrman et al. |
| 7,194,376 | B2 | 3/2007 | Zarabadi |

(Continued)

*Primary Examiner* — Marlon Fletcher
(74) *Attorney, Agent, or Firm* — Schmeiser, Olsen & Watts LLP

(57) ABSTRACT

An electric instrument music control device is provided having at least two multi-axis position sensors. One sensor is a reference multi-axis position sensor having at least one axis held in a fixed position. Another sensor is a moveable multi-axis position sensor rotatable about at least one axis corresponding to the at least one axis of the reference multi-axis position sensor. The electric music control device also includes a processor in communication with both the reference multi-axis position sensor and the moveable multi-axis position sensor. The processor calculates an angular difference in response to receiving the angular position of the at least one axis of the reference multi-axis position sensor and the angular position of the at least one axis of the moveable multi-axis position sensor. The angular difference correlates to a music effect of an electric instrument.

9 Claims, 11 Drawing Sheets

U.S. PATENT DOCUMENTS

| | | | | |
|---|---|---|---|---|
| 7,243,542 | B2 | 7/2007 | Hulsing, II | |
| 7,521,626 | B2 * | 4/2009 | Muramatsu | 84/719 |
| 7,589,275 | B2 * | 9/2009 | Arimoto | 84/723 |
| 7,919,708 | B2 * | 4/2011 | Komatsu | 84/746 |
| 7,923,623 | B1 * | 4/2011 | Beaty | 84/701 |
| 2001/0045128 | A1 | 11/2001 | McCall et al. | |
| 2005/0257672 | A1 * | 11/2005 | Arimoto | 84/738 |
| 2006/0169041 | A1 | 8/2006 | Madni et al. | |
| 2006/0272413 | A1 | 12/2006 | Vaganov et al. | |
| 2006/0278068 | A1 * | 12/2006 | Nielsen et al. | 84/746 |
| 2007/0135739 | A1 | 6/2007 | Halperin et al. | |

* cited by examiner

ELECTRIC INSTRUMENT MUSIC CONTROL DEVICE WITH MULTI-AXIS POSITION SENSORS

CROSS REFERENCE TO RELATED APPLICATION

This application claims priority to U.S. patent application to David Beaty entitled "ELECTRIC INSTRUMENT MUSIC CONTROL DEVICE WITH MULTI-AXIS POSITION SENSORS," Ser. No. 12/253,852, filed Oct. 17, 2008, the disclosure of which is hereby incorporated entirely herein by reference.

BACKGROUND OF THE INVENTION

1. Technical Field

This invention relates generally to electric instrument music control devices and more particularly to an electric instrument music control device that utilizes multi-axis position sensors to control various music effects.

2. State of the Art

The use of a pedal to control effects of an electric instrument is often employed by a musician to control effects such as volume, vibrato, tone or other types of music effects of an electric instrument. Conventionally, the method in which musicians control these effects is by use of an effects pedal. A conventional effects pedal is an electronic effects unit typically housed in a chassis used by musicians to modify the sound of their instrument.

These conventional effects pedals sit on the floor and have large on/off switches on top that are activated using the foot. Some pedals, such as volume pedals, employ what is known as an expression pedal, which is manipulated while in operation by rocking a large foot-activated pedal mechanically coupled to a potentiometer in a single back and forth motion. The relative position of the expression pedal thus determines the extent to which the music effect is altered. These effects pedals permit the musician to activate and deactivate effects and/or vary the intensity of effects while playing an electric instrument.

Other conventional effects pedals include pedals that utilize light, wherein the pedal controls the amount of light that is directed to a photo cell or other light level sensing devices, the amount of light corresponding to a change in a music effect or characteristic. Further still, other conventional effects pedals include the use of a micro-controller with a bar code that is changed to effect change in the music characteristic of the instrument.

While these conventional devices control music effects of electric instruments, they have their limitations. For example, conventional effects pedals typically require the musician to use a single pedal or input device to control a single music effect, which means that in order to control volume, vibrato and tone the musician would use multiple pedals. Further, conventional pedals are subject to wear due to the mechanical operation of the potentiometer or the limited life of a light source. Conventional pedals are also limited in their ability to adjust the music effect according to various effects curves and/or with a preferred effect curve of the particular musician. Additionally, the musician needs to dedicate one foot during a performance in order to control these effects during playing of the electric instrument, thereby preventing the use of one foot that may otherwise be used for another purpose such as to generate notes with another particular electric instrument. Further still, the conventional devices are static and placed in a single location on a fixed surface.

Accordingly, there is a need in the field of electric instruments music effects devices for an improved electric music effects device that overcomes the limitations of conventional electric music effects devices.

DISCLOSURE OF THE INVENTION

This invention relates generally to electric instrument music control devices and more particularly to an electric instrument music control device that utilizes multi-axis position sensors to control various music effects.

Disclosed is an electric music control device which includes a reference multi-axis position sensor which has at least one axis held in a fixed position. The electric music control device according to the invention also includes a moveable multi-axis position sensor rotatable about at least one axis, where the at least one axis corresponds to the at least one axis of the reference multi-axis position sensor. The electric music control device also includes a processor in communication with both the reference multi-axis position sensor and the moveable multi-axis position sensor. The processor calculates an angular difference in response to receiving the angular position of the at least one axis of the reference multi-axis position sensor and the angular position of the at least one axis of the moveable multi-axis position sensor. The processor applies at least one predetermined function to the angular difference to create a processed angular difference, wherein the processed angular difference controls a music effect of an electric instrument.

In some embodiments the moveable multi-axis position sensor is rotatable about two axes, where rotation about each axis correlates to a different music effect. In some embodiments the processed angular difference for the at least one axis of rotation is used to control two different musical effects. In some embodiments the at least one predetermined function is a polarity reverse function. In some embodiments the at least one predetermined function is a minimum signal function. In some embodiments the at least one predetermined function is a fixed gain function. In some embodiments the fixed gain function is a fixed gain equal to ⅓. In some embodiments the at least one predetermined function is a variable gain function.

An electric music control device is disclosed which is an electric music control foot pedal. The electric music control foot pedal includes a base portion and a pedal portion coupled to the base portion, where the pedal portion is allowed to move in at least one axis with respect to the base portion. A reference multi-axis position sensor is mounted in the base portion. The reference multi-axis position sensor mounted in the base portion has at least one axis held in a fixed position, where the at least one axis corresponds to the at least one axis that the pedal portion is allowed to move in. A moveable multi-axis position sensor is mounted in the pedal portion. The moveable multi-axis position sensor mounted in the pedal portion is rotatable about at least one axis, where the at least one axis corresponds to the at least one axis the pedal portion is allowed to move in. The electric music control foot pedal further includes a processor in communication with both the reference multi-axis position sensor and the moveable multi-axis position sensor. The processor creates an angular difference in response to receiving the angular position of the at least one axis of the reference multi-axis position sensor and the angular position of the at least one axis of the moveable multi-axis position sensor. The angular difference controls a music effect of an electric instrument.

In some embodiments the music control foot pedal includes a database which stores in a look-up table predetermined functions correlating to a desired music effect. In some embodiments the processor is adapted to compare the angular different with the predetermined functions stored in the database and apply the music effect corresponding to the angular difference. In some embodiments the music control foot pedal includes a drag adjustment device. In some embodiments the music control foot pedal includes a tension adjustment device.

The foregoing and other features and advantages of the present invention will be apparent from the following more detailed description of the particular embodiments of the invention.

BRIEF DESCRIPTION OF THE DRAWINGS

The invention will hereinafter be described in conjunction with the appended drawings where like designations denote like elements, and.

DETAILED DESCRIPTION OF EMBODIMENTS OF THE INVENTION

This invention relates generally to electric instrument music control devices and more particularly to an electric instrument music control device that utilizes multi-axis position sensors to control various music effects. An electric instrument music control device 10 according to the invention is described which includes at least two multi-axis position sensors, wherein music control device 10 controls one or more than one music characteristic with movement of one of the multi-axis position sensors.

Figure 1:
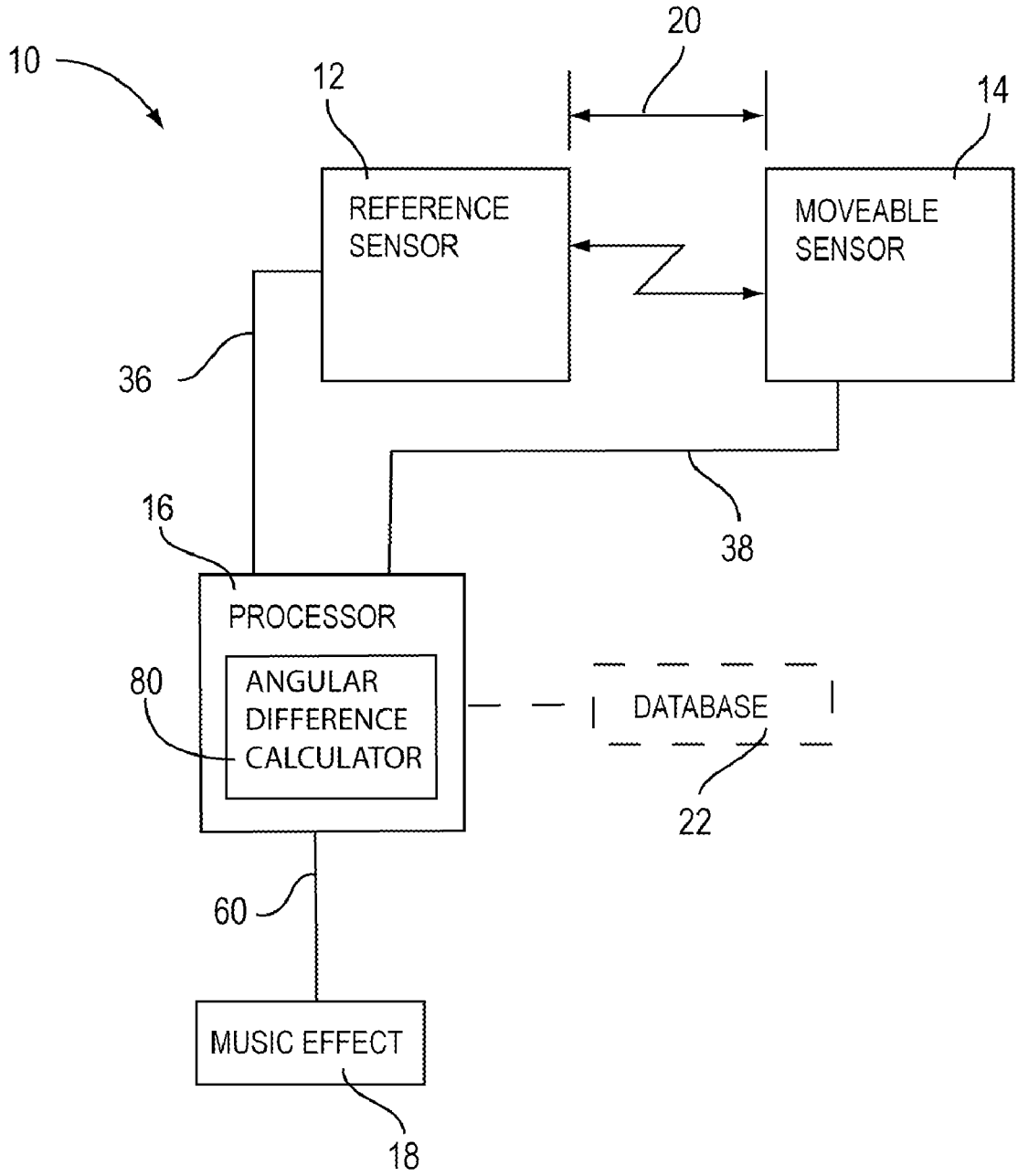
FIG. 1 is a schematic view of one embodiment of music control device 10 in accordance with the invention.

Referring to FIG. 1, electric instrument music control device 10 according to the invention is shown schematically including two multi-axis position sensors, reference multi-axis position sensor 12 and moveable multi-axis position sensor 14. Each multi-axis position sensor 12 and 14 is a sensor that is used to measure acceleration. Each sensor 12 and 14 includes signal conditioned voltage outputs, which are all on a single monolithic integrated circuit ("IC"). Each sensor 12 and 14 measures acceleration with a predetermined reliability factor. Each sensor 12 and 14 measures both dynamic acceleration (vibration) and static acceleration (gravity).

Each multi-axis position sensor 12 and 14 includes in this embodiment a polysilicon surface micromachined sensor and signal conditioning circuitry to implement an open-loop acceleration measurement architecture. Each multi-axis position sensor 12 and 14 senses angles and acceleration in any direction. The output signals are analog voltages that are proportional to acceleration. Each multi-axis position sensor 12 and 14 may also be used as a tilt sensor, wherein the accelerometer measures static acceleration forces, such as gravity, which allows it to be used as a tilt sensor. When a multi-axis position sensor 12 or 14 is oriented so both its X-axis and Y-axis are parallel to the earth's surface, it can be used as a two-axis tilt sensor with both a roll axis and a pitch axis.

Figure 2:
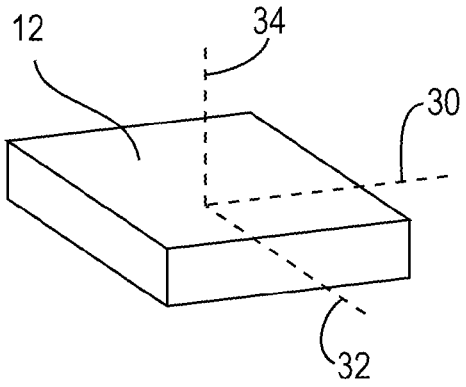
FIG. 2 is perspective view of one embodiment of reference multi-axis position sensor 12 according to the invention.
Figure 3:
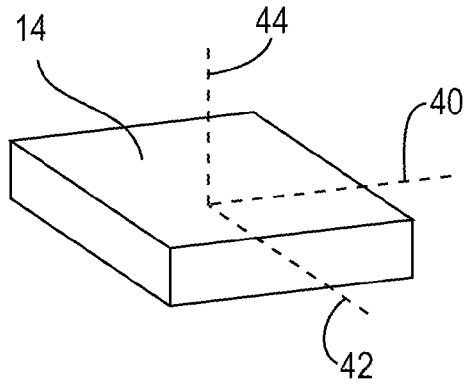
FIG. 3 is a perspective view of one embodiment of moveable multi-axis position sensor 14 according to the invention.

FIG. 2 and FIG. 3 show embodiments of reference multi-axis position sensor 12 according to the invention (FIG. 2) and moveable multi-axis position sensor 14 according to the invention (FIG. 3). Multi-axis position sensors 12 and 14 in this embodiment are formed from micromachined polysilicon. In some embodiments multi-axis position sensors 12 and 14 take other forms. Multi-axis position sensors 12 and 14 can be any position sensors which provide data corresponding to their angular position relative to at least one axis of rotation.

Electric instrument music control device 10 includes at least two multi-axis position sensors 12 and 14. Reference multi-axis position sensor 12 is retained in a fixed position. Retaining reference multi-axis position sensor 12 in a fixed position includes retaining it such that the angle of reference sensor 12 is static relative to the X-axis 30, Y-axis 32 and Z-axis 34. Reference sensor 12 held in a fixed position is used as a reference angular position for music control device 10. Reference sensor 12 outputs reference angular position signal 36. Reference angular position signal 36, also referred to as 36*x,y,z*, represents the angular position of reference sensor 12 with respect to X-axis 30, Y-axis 32, and Z-axis 34. Reference multi-axis position sensor 12 is held in a fixed position, which means that reference angular position signal 36 is constant (static or fixed), reflecting the constant fixed position of reference multi-axis position sensor 36. In this way reference multi-axis position sensor 12 has at least one axis held in a fixed position.

In some embodiments reference multi-axis position sensor 12 is held fixed about only X-axis 30. In this embodiment angular position signal 36 represents the fixed angular position of reference multi-axis position sensor 12 with respect to X-axis 30 and is designated 36*x*. In some embodiments reference multi-axis position sensor 12 is held fixed about only Y-axis 32. In this embodiment angular position signal 36 represents the fixed angular position of reference multi-axis position sensor 12 with respect to Y-axis 32 and is designated 36*y*. In some embodiments reference multi-axis position sensor 12 is held fixed about only Z-axis 34. In this embodiment angular position signal 36 represents the fixed angular position of reference multi-axis position sensor 12 with respect to Z-axis 34 and is designated 36*z*.

Moveable multi-axis sensor 14 according to the invention is rotatable about at least one axis. The rotation about the at least one axis of moveable sensor 14 controls an effect of an electric instrument. The at least one axis may be any one of the X-axis 40, the Y-axis 42 and the Z-axis 44. The at least one axis that moveable multi-axis position sensor 14 is rotatable about corresponds to an at least one axis that reference multi-axis position sensor 12 is held fixed in. In this way moveable multi-axis position sensor 14 is rotatable about at least one axis corresponding to the at least one axis that reference multi-axis position sensor 12 is held fixed in.

Moveable multi-axis position sensor 14 outputs angular position signal 38. Angular position signal 38 represents the angular position of moveable multi-axis sensor 14 with respect to X-axis 40, Y-axis 42, and Z-axis 44. In some embodiments moveable multi-axis position sensor 14 is rotatable about only X-axis 40. In this embodiment angular position signal 38 represents the angular position of moveable multi-axis position sensor 14 with respect to X-axis 40 and is designated 38*x*. In some embodiments moveable multi-axis position sensor 14 is rotatable about only Y-axis 42. In this embodiment angular position signal 38 represents the angular position of moveable multi-axis position sensor 14 with respect to Y-axis 42 and is designated 38*y*. In some embodiments moveable multi-axis position sensor 14 is rotatable about only Z-axis 44. In this embodiment angular position signal 38 represents the angular position of moveable multi-axis position sensor 14 with respect to Z-axis 44 and is designated 38*z*.

In some embodiments moveable multi-axis position sensor is rotatable about two of the three axes. In this embodiment angular position signal 38 represents the angular position of moveable multi-axis position sensor 14 with respect to the two axes that moveable multi-axis position sensor 14 is rotatable about.

In some embodiments moveable multi-axis position sensor is rotatable about X-axis 40, Y-axis 42, and Z-axis 44. In this embodiment angular position signal 38 represents the angular position of moveable multi-axis position sensor 14 with respect to X-axis 40, Y-axis 32, and Z-axis 44 and is designated 38*x,y,z*.

Reference and moveable sensors 12 and 14 need not be in close proximity to each other, but rather are attitude dependent, meaning that a change in angular position 36 or 38 about a particular axis with respect to each other determines the operation of music control device 10. Accordingly, reference sensor 12 and moveable sensor 14 may be widely separated a distance 20. In some embodiments distance 20 between reference sensor 12 and moveable sensor 14 is a dynamic distance 20 that changes in response to movement of a musician, with moveable sensor 14 coupled to the musician, the musician moving moveable sensor 14 toward and away from reference sensor 12.

Music control device 10 further includes processor 16. Reference multi-axis position sensor 12 and moveable multi-axis position sensor 14 are both in communication with processor 16. Processor 16 receives reference angular position signal 36 and angular position signal 38. In some embodiments this communication is accomplished with a wired connection. In some embodiment this communication is a wireless connection. In some embodiments communication between moveable multi-axis position sensor 14 and processor 16 occurs through a wireless connection. In some embodiments this wireless connection is a Bluetooth™ connection. In some embodiments this wireless connection is a wireless local area network connection. In some embodiments this wireless connection is a different type of wireless connection.

Processor 16 is used to compare the angle of moveable sensor 14 about at least one of the X-axis 40, the Y-axis 42 and the Z-axis 44 relative to the angle of the reference sensor 12 about the same axis. Processor 16 has angular difference calculator 80 which calculates angular difference 60 in response to receiving reference angular position 36 from reference multi-axis position sensor 12 and angular position 38 from moveable multi-axis position sensor 14, as shown in FIG. 1. Angular difference 60 represents the difference in angular position of moveable multi-axis position sensor 14 as compared to the angular position of reference multi-axis position sensor 12 in one or more than one of the X, Y, or Z axes.

Angular difference 60 between reference and moveable sensors 12 and 14 about the at least one axis correlates to a certain change in music effect 18. For example and without limitation, music effect 18 may be the volume of an electric instrument. As moveable sensor 14 is rotated about at least one axis, the change in the angular difference between moveable sensor 14 relative to the fixed angle of reference sensor 12 establishes a change in the volume of the electric instrument. Maintaining moveable sensor 14 in a fixed position once a desired music characteristic or effect is reached will maintain that music characteristic constant. In this way angular difference 60 can be used to control the music effect of an electric instrument.

In some embodiments electric music control device 10 includes database 22, which is used to store predetermined functions to be applied to angular difference 60, as will be discussed shortly. Database 22 is not included in all embodiments of electric music control device 22, and so is shown in dotted lines indicating it is an optional component of electric music control device 10.

Figure 4:
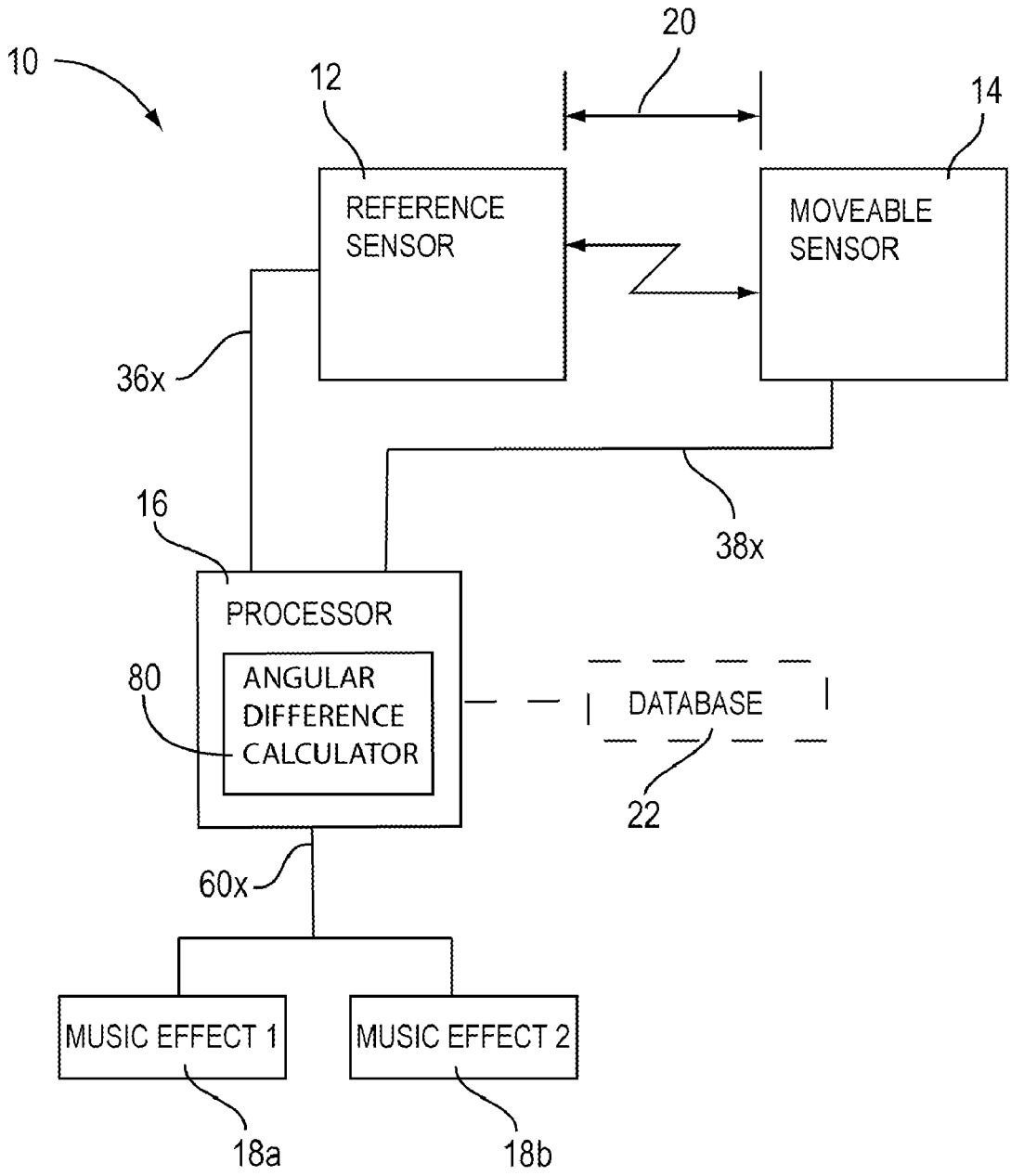
FIG. 4 is a schematic view of another embodiment of music control device 10 according to the invention.

In some embodiments angular difference 60 is used to control more than one music effect 18, as shown in FIG. 4. FIG. 4 shows an embodiment of music control device 10 where angular difference 60 is being used to control two different music effects, 18*a* and 18*b*. In this embodiment, reference multi-axis position sensor 12 is held fixed in X-axis 30 and sends reference angular position 36*x* to processor 16. Moveable multi-axis position sensor 14 moves in X-axis 40 and sends angular position 38*x* to processor 16. Angular difference calculator 80 of processor 16 creates angular difference 60*x*, which represents the angular difference in the X-axis of moveable multi-axis position sensor 14 as compared to reference multi-axis position sensor 12. Angular difference 60*x* is used to control two music effects 18*a* and 18*b*. For example but not by way of limitation, angular difference 60 can be used to control music effect 18*a* which is volume, and music effect 18*b* which is tone. Music effects 18*a* and 18*b* can be any controllable music effects. In some embodiments angular difference 60 can be used to control more than two music effects. Controllable music effects 18 include, but are not limited to wah, distortion, pitch, volume, tone, vibrato, etc.

Some embodiments of music control device 10 include three or more multi-axis position sensors, with reference sensor 12 being one of the multi-axis position sensors. Reference sensor 12 may be held in a fixed position and every other sensor may be a moveable sensor 14 that may be rotatable about at least one axis. Each moveable sensor 14 may then be used to control music effects 18.

Figure 5:
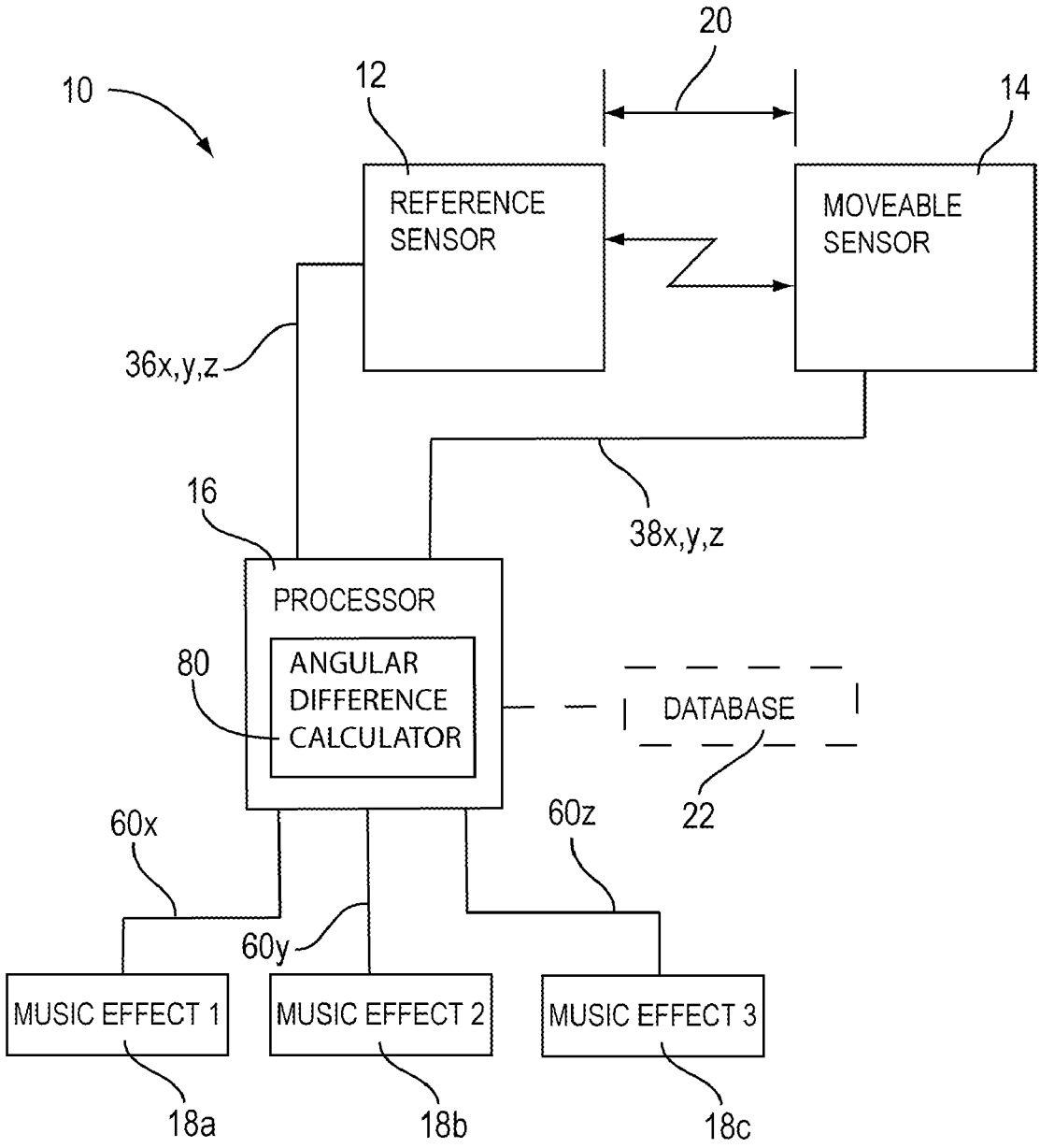
FIG. 5 is a schematic view of a further embodiment of music control device 10 according to the invention.

In the embodiment of electric music control device 10 according to the invention shown in FIG. 5, moveable multi-axis position sensor 14 is rotatable about three axes. Rotation of moveable multi-axis position sensor 14 about multiple axes allows music control device 10 to control a different music effect or characteristic with each angular difference signal 60*x*, 60*y*, and 60*z*. Processor 16 computes angular difference signal 60*x*, which is the angular difference between moveable multi-axis position sensor 14 and reference multi-axis position sensor 12 in the X-axis, and angular difference signal 60*y*, which is the angular difference between moveable multi-axis position sensor 14 and reference multi-axis position sensor 12 in the Y-axis, and angular difference signal 60*z*, which is the angular difference between moveable multi-axis position sensor 14 and reference multi-axis position sensor 12 in the Z-axis. Each of these angular difference signals 60*x*, 60*y*, and 60*z* can be used to control one or more than one music effect. In the embodiment shown in FIG. 5, the rotation of moveable sensor 14 about the X-axis 40 or roll, which is reflected in angular difference signal 60*x*, controls music effect 18*a* which is volume of the instrument. Rotation of moveable sensor 14 about the Y-axis 42 or pitch, which is reflected in angular difference signal 60*y*, controls music effect 18*b* which is the vibrato of the instrument, and rotation of moveable sensor 14 about the Z-axis 44 or yaw which is reflected in angular difference signal 60*z*, controls the music effect 18*c* which is the tone of the instrument. In this way music control device 10 includes moveable multi-axis position sensor 14 which is rotatable about three axes, wherein the rotation about each axis correlates to a different music effect.

It will be understood that these music effects 18*a*, 18*b*, and 18*c* are not a limitation but merely an example of the types of music effects 18 or characteristics that may be controlled by the music control device 10. Other music effects may be controlled, such as, but not limited to wah, distortion, pitch and the like.

In some embodiments of music control device 10 according to the invention, moveable multi-axis position sensor 14 is rotatable about two axes, where rotation about each of the two axes controls one or more than one music effect 18. In this way music control device 10 includes moveable multi-axis position sensor 14 which is rotatable about two axes, wherein the rotation about each axis correlates to a different music effect.

Figure 6:
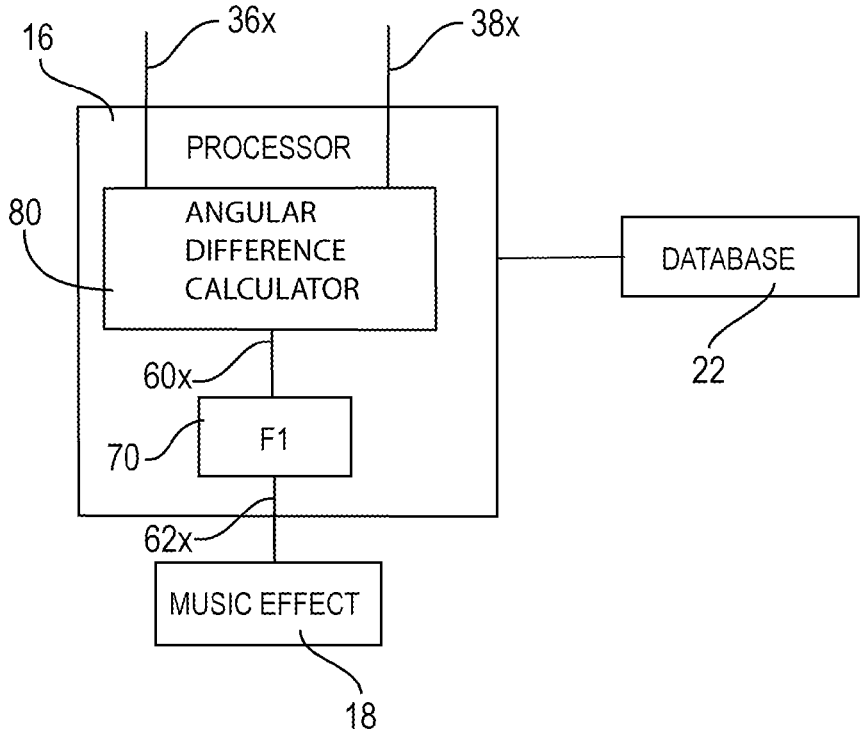
FIG. 6 shows a schematic view of one embodiment of processor 16 which can be used in music control device 10 according to the invention as shown in FIG. 1, FIG. 4, and FIG. 5.
Figure 7:
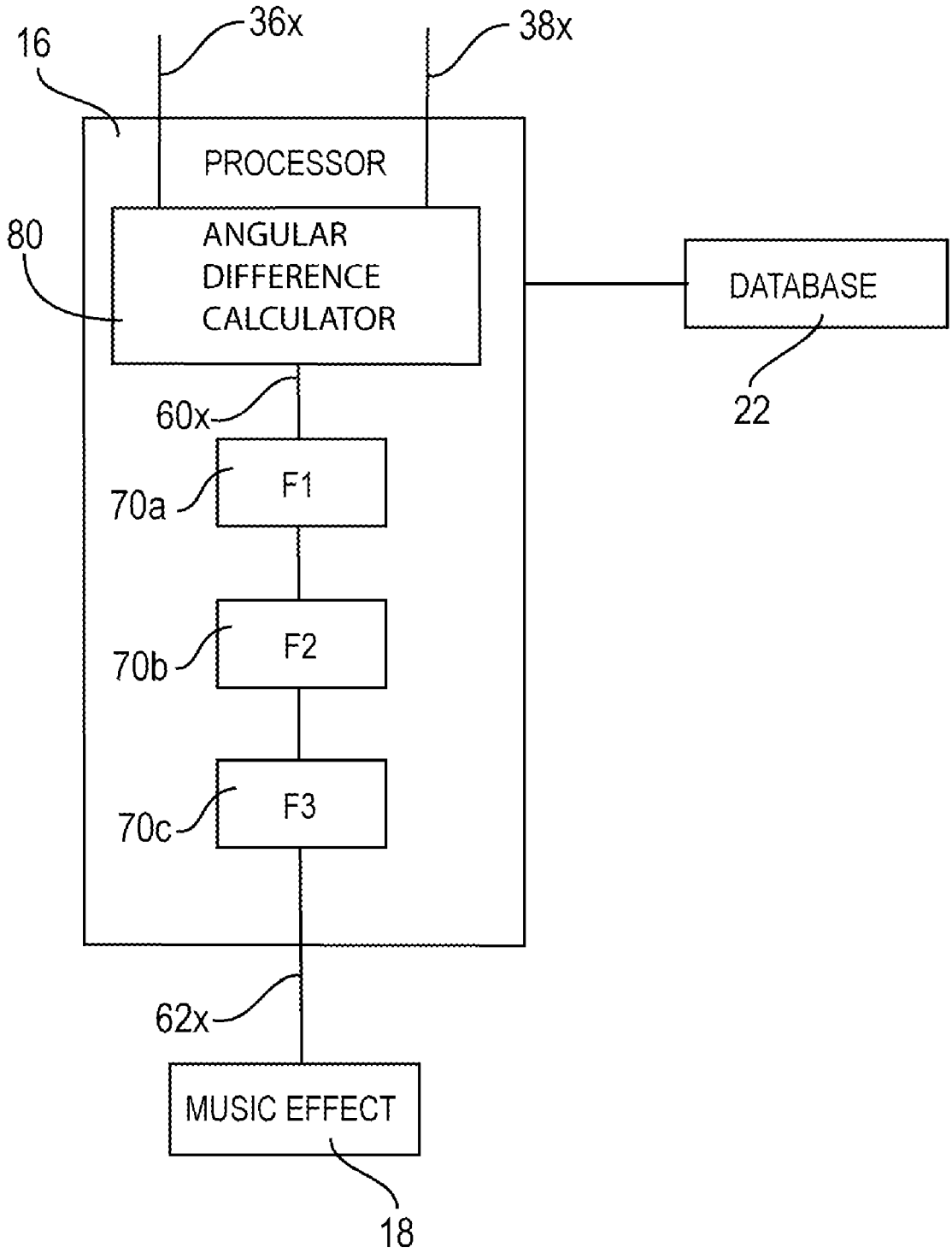
FIG. 7 shows a schematic view of another embodiment of processor 16 which can be used in music control device 10 according to the invention as shown in FIG. 1, FIG. 4, and FIG. 5.
Figure 8:
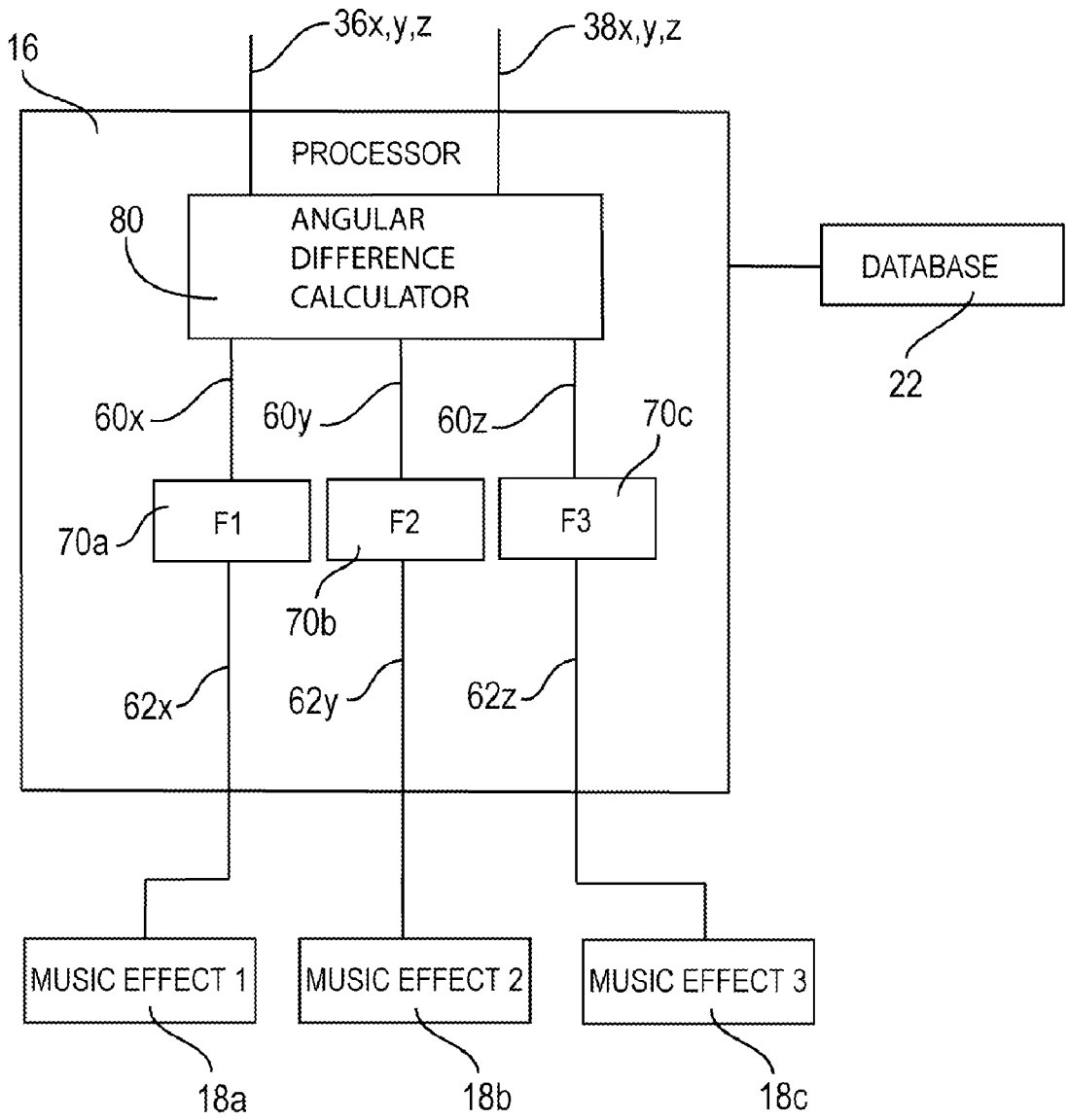
FIG. 8 shows a schematic view of a further embodiment of processor 16 which can be used in music control device 10 according to the invention as shown in FIG. 1, FIG. 4, and FIG. 5.

In some embodiments of music control device 10, processor 16 includes predetermined functions 70 which can be applied to angular difference signal 60 to modify music effect 18. FIG. 6, FIG. 7, and FIG. 8 each show alternate schematic embodiments of processor 16. In these embodiments processor 16 uses database 22 to store one or more functions 70 correlating to a desired music effect. This allows music control device 10 to measure angular difference 60 between reference and moveable multi-axis position sensors 12 and 14 and then depending on the measured angular difference 60, music control device 10 applies predetermined function 70 to angular difference 60, where predetermined function 70 can represent a change, a rate of change or other music expression that generates or manipulates music effect 18 of the electric instrument.

FIG. 6 shows an embodiment of processor 16 where angular difference 60*x* is multiplied by function 70 to create processed angular difference 62*x*. Processed angular difference 62*x* can be used to control one or more than one music effect 18 as discussed previously. In this way processor 16 applies at least one predetermined function 70 to angular difference 60 to create processed angular difference 62, where processed angular difference 62 controls a music effect of an electric instrument.

FIG. 7 shows an embodiment of processor 16 where angular difference 60*x* is multiplied by multiple different functions 70 which include function 70*a*, function 70*b*, and function 70*c*. The multiplication of angular difference 60*x* by function 70*a*, function 70*b*, and function 70*c* results in processed angular difference signal 62*x*, which is used to control music effect 18. In some embodiments angular difference 60*x* is multiplied by more than three functions. In some embodiments angular difference 60*x* is multiplied by two functions. In this way processor 16 applies more than one predetermined function 70 to angular difference 60 to create processed angular difference 62, where processed angular difference 62 controls a music effect of an electric instrument.

FIG. 8 shows an embodiment of processor 16 in which processor 16 calculates angular difference 60 for each of three different axes, resulting in angular difference 60*x*, 60*y*, and 60*z*. Angular difference 60*x*, 60*y*, and 60*z* are then multiplied by predetermined function 70*a*, 70*b*, and 70*c* respectively, resulting in processed angular difference 62*x*, 62*y*, and 62*z*, a different processed angular difference for each axis, where the processed angular differences 62*x*, 62*y*, and 62*z* for each axis have been multiplied by a predetermined function 70*a*, 70*b*, and 70*c*. Processed angular difference 62*x*, 62*y*, and 62*z* are each used to control a music effect 18. In this way processor 16 applies more than one predetermined function 70 to angular difference 60 for more than one axis to create processed angular difference 62 for multiple axes of rotation, where each processed angular difference 62 controls a music effect 18 of an electric instrument. In some embodiments each angular difference signal 60*x*, 60*y*, and 60*z* are multiplied by the same function 70. In some embodiments each angular difference signal 60*x*, 60*y*, and 60*z* are multiplied by more than one predetermined function 70. In this way processor 16 calculates a first angular difference 60*x* for first axis of rotation 40 and second angular difference 60*y* for second axis of rotation 42 and processor 16 applies first predetermined function 70*a* to first angular difference 60*x* and second predetermined function 70*b* to second angular difference 60*y*, where function 70*a* is different from function 70*b*. In this embodiment rotation about each of the multiple axes correlates to a different music effect 18.

In some embodiments processor 16 is adapted to compare angular difference 60 with functions 70 in database 22. Function 70 can be a look-up table stored in database 22. Function 70 may be multiple look-up tables, each look-up table corresponding to a particular axis of rotation of moveable multi-axis sensor 14, thereby controlling a particular music effect 18.

In these embodiments, music control device 10 allows a musician in real time to select a particular desired effect and curve for the effect from the one or more than one functions 70 and associate the selected effect and effect curve with a particular axis of a multi-axis sensor 14. This allows the musician to assign a particular effect 18 to a particular axis as well as assigning a particular effect curve with the axis. Functions 70 are customizable by the musician, wherein the musician may store particular preferred functions 70 that are accessed from database 22 during operation of music control device 10.

Predetermined functions 70 can be many different types. In some embodiments function 70 is a polarity reverse function. A polarity reverse function reverses the polarity of angular difference 60, which has the same effect as when moveable multi-axis position sensor 14 is rotated about the particular axis by 180 degrees. The result of the polarity reverse function is to reverse the polarity of music effect 18. For example, using FIG. 6 to explain, processed angular difference signal 62*x* is controlling music effect 18 where music effect 18 is a volume control. Before function 70 is applied to angular difference 60*x*, where function 70 is a polarity reverse function, larger angular movement of moveable multi-axis position sensor 14 results in music effect 18 of increasing the volume of the music. After function 70 is applied to angular difference 60*x*, where function 70 is a polarity reverse function, larger angular movement of moveable multi-axis position sensor 14 results in music effect 18 of decreasing the volume of the music. In this way polarity reverse function 70 reverses the polarity of the music effect 18 controlled by processed angular difference 62*x*.

In some embodiments function 70 is a minimum signal function. Minimum signal function 70 prevents angular difference 60 from passing through function 70 until angular difference 60 reaches a predetermined minimum level, at which point angular difference 60 is allowed to pass through function 70 and become processed angular difference 62. The effect of minimum signal function 70 is to prevent movements, noise and vibrations smaller than the predetermined level from passing through function 70 to become music effect 18. Small movements, noise, and vibrations are filtered out by minimum signal function 70, increasing the quality of music from the electric instrument.

In some embodiments function 70 is a fixed gain function. Fixed gain function 70 has the effect of multiplying (or applying) a fixed number to angular difference 60, wherein the fixed number does not change as the angular difference changes. In a particular example, fixed gain function 70 has a fixed gain of ⅓. This means that angular difference 60 is multiplied by ⅓ to become processed angular difference 62. A movement of 3 degrees of moveable multi-axis position sensor 14 will therefore result in a change of only 1 degree in processed angular difference signal 62. In this particular case music effect 18 will be ⅓ less sensitive to movement of moveable multi-axis position sensor 14 about the particular axis. This fixed gain function 70 is useful to make processed angular difference signal 62 and music effect 18 less sensitive to movement of multi-axis position sensor 14 than angular difference signal 60 is. A fixed gain function 70 where the gain is a number greater than one will make processed angular difference signal 62 and music effect 18 more sensitive to movement of multi-axis position sensor 14 than angular difference signal 60 is.

In some embodiments function 70 is a variable gain function. Variable gain function 70 will apply a numeric gain value to angular difference 60 to create processed angular difference 62 where the numeric gain value varies in some predetermined manner across the range of angular movement. The manner in which variable gain function 70 varies versus angle can be stored in a look-up table as discussed earlier. Or variable gain function 70 can be stored as a numeric equation. These variable gain functions 70 are often called tapers by musicians. Taper functions are used to match different music control devices, or to obtain a specific effect by changing a music effect 18 in a specific way over angular movement. As discussed earlier, processor 16 uses database 22 to store multiple variable gain functions 70 for use as needed.

Figure 9:
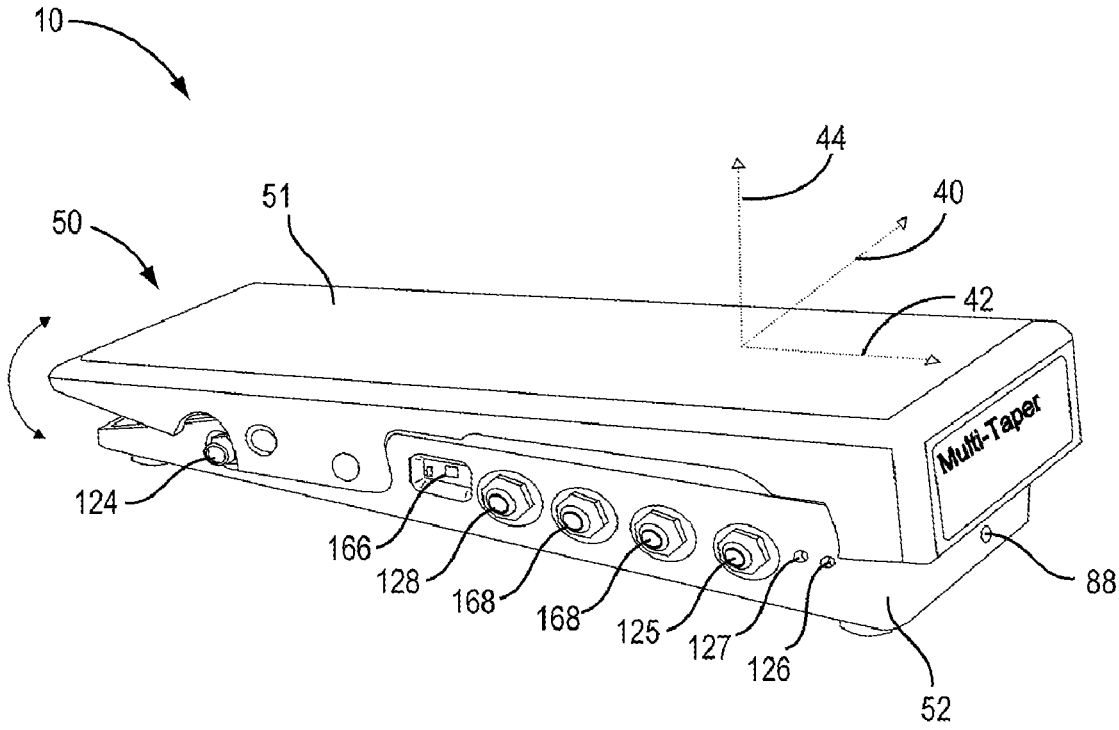
FIG. 9 shows a perspective view of music control device 10 embodied as music control foot pedal 50 according to the invention.
Figure 10:
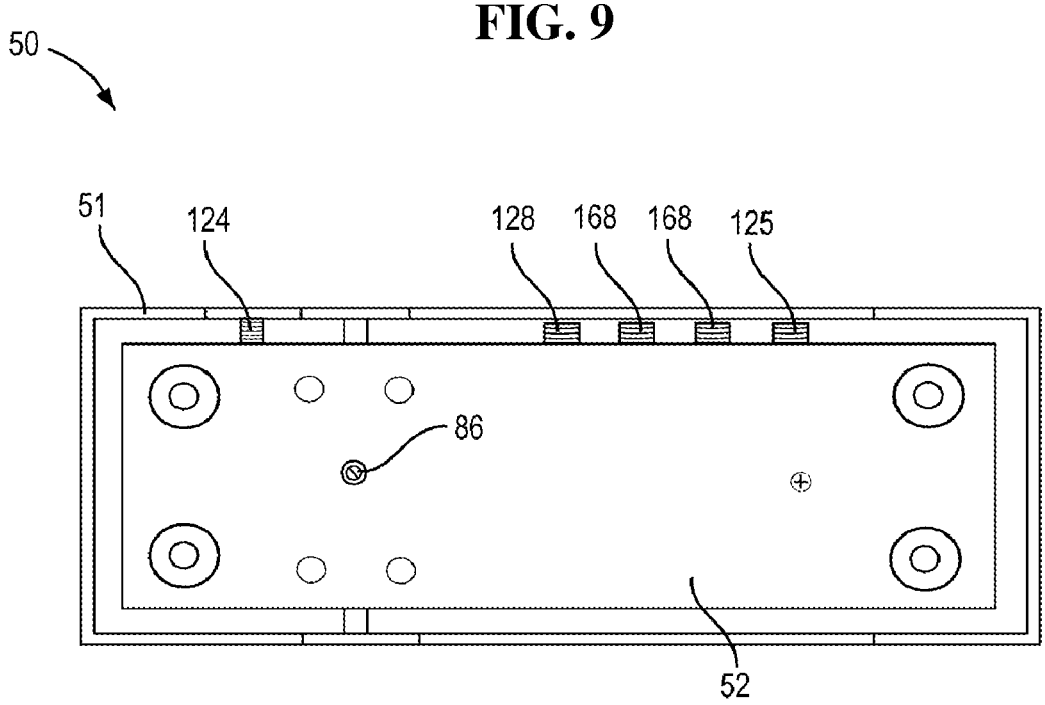
FIG. 10 shows a bottom view of music control foot pedal 50 of FIG. 9.
Figure 11:
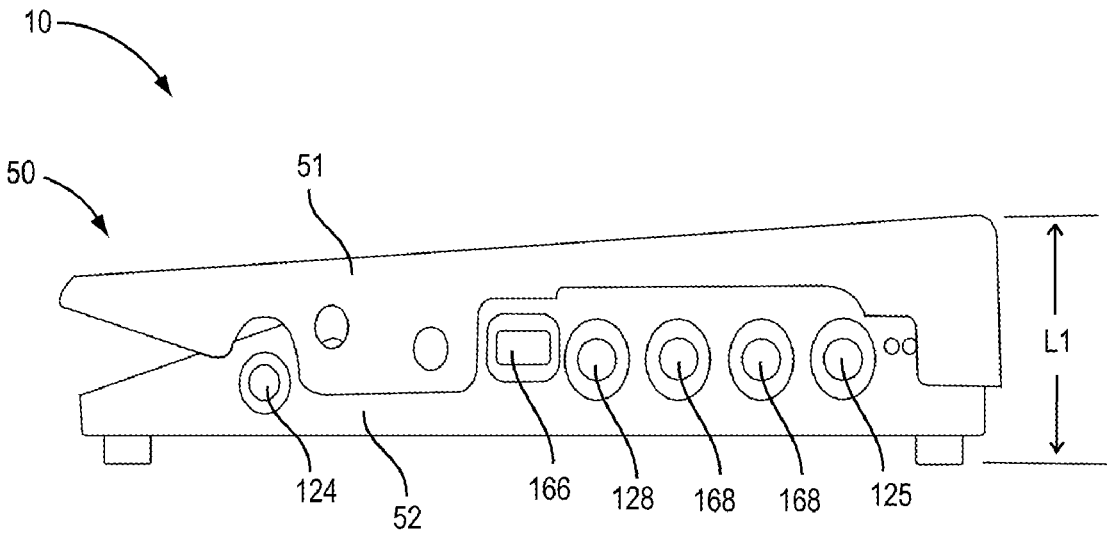
FIG. 11 shows a side view of music control foot pedal 50 of FIG. 9 in a low-profile condition.
Figure 12:
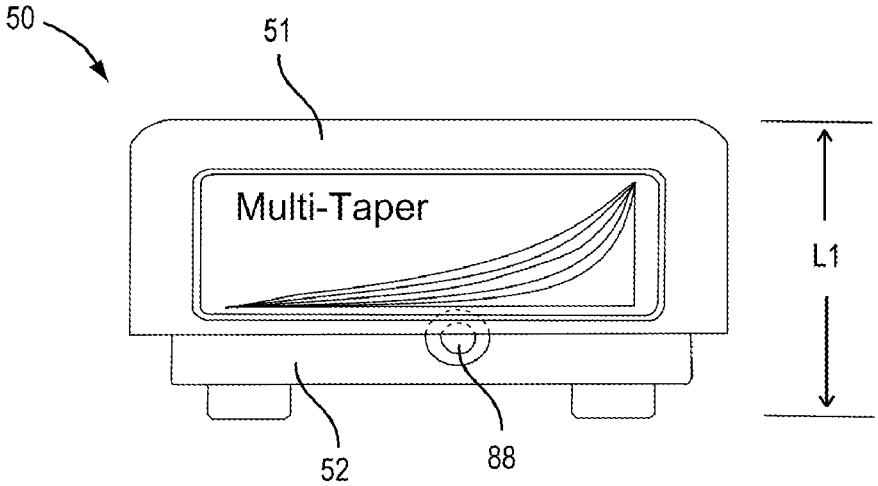
FIG. 12 shows a front view of music control foot pedal 50 of FIG. 9 in a low-profile condition.
Figure 13:
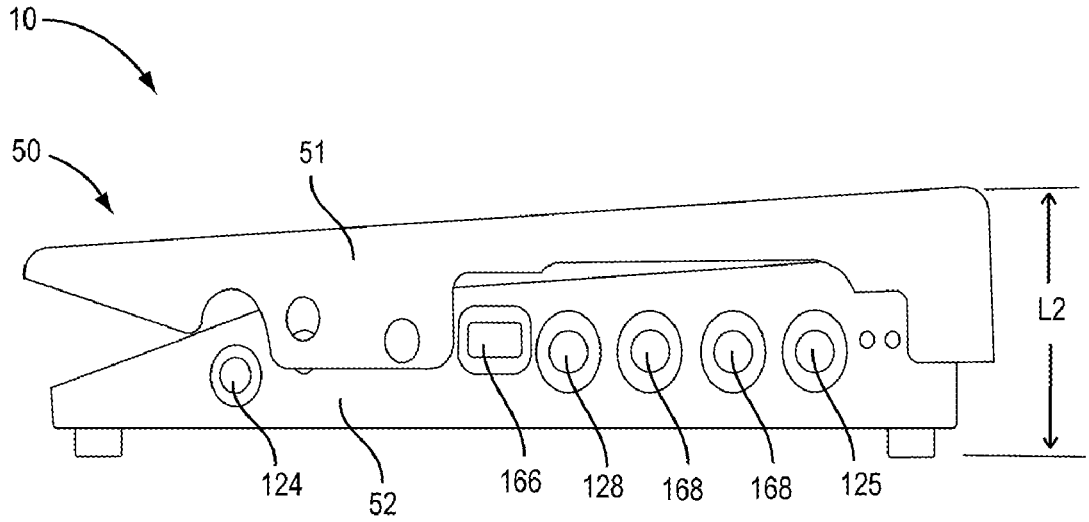
FIG. 13 shows a side view of music control foot pedal 50 of FIG. 9 in a high-profile condition.
Figure 14:
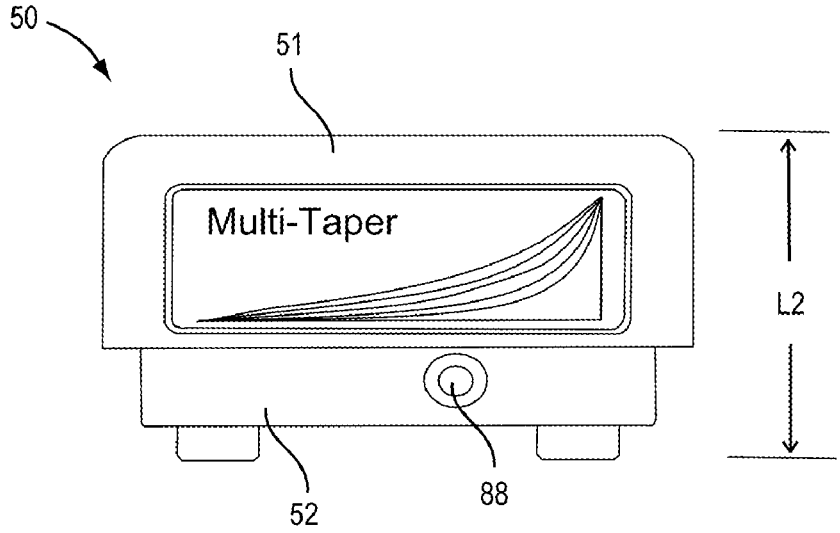
FIG. 14 shows a front view of music control foot pedal 50 of FIG. 9 in a high-profile condition.

Referring now to FIG. 9 through FIG. 14, electric instrument music control device 10 takes the form of foot pedal 50, wherein foot pedal 50 has pedal portion 51 which is rotatable about at least one axis. FIG. 9 shows a perspective view of electric music control foot pedal 50 according to the invention. FIG. 10 shows a bottom view of electric music control foot pedal 50 of FIG. 9. FIG. 11 shows a side view of electric music control foot pedal 50 of FIG. 9 with electric music control foot pedal 50 in the low-profile condition. FIG. 12 shows a front view of electric music control foot pedal 50 of FIG. 9 with electric music control foot pedal 50 in the low-profile condition. FIG. 13 shows a side view of electric music control foot pedal 50 of FIG. 9 with electric music control foot pedal 50 in the high-profile condition. FIG. 14 shows a front view of electric music control foot pedal 50 of FIG. 9 with electric music control foot pedal 50 in the high-profile condition. Foot pedal 50 includes base portion 52 and pedal portion 51. Base portion 52 supports pedal portion 51 and a rotation mechanism that allows pedal portion 51 to be rotated about at least one axis by applying force on pedal portion 51 corresponding to rotation about the at least one axis. Base portion 52 retains reference multi-axis position sensor 12 in a fixed position as explained earlier with regard to FIG. 1 through FIG. 8. Pedal portion 51 retains moveable multi-axis position sensor 14 as explained with regard to FIG. 1 through FIG. 8. As pedal portion 51 is rotated about an axis, moveable sensor 14 is also rotated about the axis. Reference and moveable sensors 12 and 14 are in communication with processor 16 in base portion 52. Angular difference calculator 80 of processor 16 calculates angular difference 60 between angular position 38 of moveable sensor 14 and angular position 36 of reference sensor 12 with respect to one or more than one axis of rotation, as discussed earlier. Angular difference 60 produces a desired change in a music effect 18. Reference and moveable sensors 12 and 14 communicate with processor 16 in some embodiments through a wired connection. In some embodiments, wireless communication between reference and moveable sensors 12 and 14 and processor 16 is used, such as a Bluetooth™ communication, infra red or other wireless communication.

Electric music control foot pedal 50 can be in one of two mechanical positions—a low profile condition or a high profile condition. In the low-profile condition pedal portion 51 is positioned a distance L1 from the bottom of base portion 52. In the high-profile condition pedal portion 51 is positioned a distance L2 from the bottom of base portion 52. Distance L2 is larger than distance L1 so pedal portion 51 of electric music control foot pedal 50 in the high profile condition sits higher off of base portion 52 than it does in the low-profile condition, as shown in FIG. 11 through FIG. 14. FIG. 11 and FIG. 12 show electric music control foot pedal 50 in the low-profile condition, where foot pedal 50 has an overall height of L1. FIG. 13 and FIG. 14 show electric music control foot pedal 50 in the high-profile condition, where foot pedal 50 has an overall height of L2. In this way foot pedal 50 can be adjusted between at least two mechanical positions, where the height of foot pedal 50 in the first position is larger than the height of foot pedal 50 in the second position.

Reference multi-axis position sensor 12, moveable multi-axis position sensor 14, processor 16, angular difference calculator 80, and in some embodiments database 22 in base portion 52 of foot pedal 50 have all the capabilities and uses as explained with respect to music device 10 shown in FIG. 1 through FIG. 8. Processor 16 in base portion 52 has angular difference calculator 80. In some embodiments database 22 is used to store predetermined functions 70 which can be applied to angular difference signal 60 prior to creating music effects 18.

Electric music control foot pedal 50 of FIG. 9 through FIG. 14 includes power input port 124. Power input port 124 in this embodiment accepts 24 volts direct current power to power sensors 12 and 14, processor 16, database 22, and all other circuitry associated with electric music control foot pedal 50.

Electric music control foot pedal 50 in this embodiment also includes taper switch 166. Taper switch 166 is used for choosing which function 70 is to be applied to angular difference signal 60. In this embodiment taper switch 166 is a ten-position switch, allowing one of ten different tapers, or variable gain functions, to be chosen and applied to angular difference 60 as explained earlier with regard to FIG. 6 through FIG. 8.

Input jack 125 of electric music control foot pedal 50 accepts both high and low impedance inputs signals, and both balanced and unbalanced input signals. Input jack 125 accepts unbalanced high impedance sources. Input jack 125 also accepts both high and low impedance balanced sources. The circuitry of electric music control foot pedal 50 detects whether the input is balanced or unbalanced and requires no switching. In some embodiments foot pedal input jack 125 will accept both monaural and stereo input source signals.

Electric music control foot pedal 50 as shown in FIG. 9 through FIG. 14 includes output jacks 168. Output jacks 168 supply output signal 60 or 62, depending on whether functions 70 are used or not. In some embodiments where foot pedal 50 is supplying monaural outputs, the signals from the two output jacks 168 are identical. In some embodiments where foot pedal 50 is supplying stereo output signals, the two output jacks 168 provide the left and right stereo output signals.

Input impedance adjust device 127 is used to adjust the input impedance of the input amplifier of foot pedal 50 of FIG. 9 through FIG. 14. In this embodiment input impedance adjustment device 127 is a set-screw. In some embodiments other input impedance adjustment means are used.

Electric music control foot pedal 50 as shown in FIG. 9 through FIG. 14 includes tuner/sensor jack 128. In this embodiment jack 128 of electric music control foot pedal 50 has dual uses. Jack 128 provides a tuner output signal which allows the user to continuously monitor tuning with pedal 50 in any position, including the full/minimum off position. When foot pedal 50 is used with moveable multi-axis position sensor 14 which is remote and hard-wired, jack 128 accepts the input from remote wired multi-axis position sensor 14. The use of remote multi-axis position sensor 14 will be discussed in detail shortly.

Electric music control foot pedal 50 as shown in FIG. 9 through FIG. 14 includes minimum ON adjustment device 126. Minimum ON adjustment device 126 is used to adjust the minimum signal level when one of the predetermined functions applied to angular difference signal 60 is a minimum signal level function 70, as discussed earlier. This adjustment controls the minimum level of audio which is allowed to pass through processor 16 when pedal 51 is fully back, or in the minimum sound level position. In this embodiment minimum ON adjustment device 126 is a set screw. Turning minimum ON adjustment device 126 in one direction raises the signal level that must be reached in order to pass through processor 16. Turning minimum ON adjustment device 126 in the opposite direction lowers the signal level that must be reached in order to pass through processor 16.

In some embodiment foot pedal 50 includes tension adjust device 88. In the embodiment shown in FIG. 9 through FIG. 14, tension adjust device 88 is a set screw which adjusts the tension of pedal portion 51 by rotation of tension adjust device 88. Tension adjust device 88 can be any mechanical adjustment device which can adjust the tension of pedal portion 51. Adjusting the tension of pedal portion 51 means adjusting the pedal return time, which is the time it takes for pedal 51 to return to a zero input force (nominal) position after all forces applied to pedal 51 are removed. Adjusting tension device 88 to increased tension means that pedal 51 takes a longer time to return to nominal position after all forces on pedal 51 are removed, in other words the pedal return time is increased. Adjusting tension device 88 to decreased tension means that pedal 51 takes a shorter time to return to nominal position after all forces on pedal 51 are removed, in other words the pedal return time is decreased. In this way foot pedal 50 includes tension adjust device 88, wherein the pedal return time changes in response to adjusting tension adjust device 88.

In some embodiments foot pedal 50 includes drag adjustment device 86. FIG. 10 shows an embodiment of drag adjustment device 86 as a set screw which can be rotated to increase or decrease drag on pedal 51. Drag is a measure of how easy or difficult pedal 51 moves. Adjusting the drag of pedal 51 means adjusting how easy or difficult it is to move pedal 51 and movable multi-axis position sensor 14 retained in pedal 51. Rotating drag adjustment device 86 in one direction increases the ease of movement of pedal 51. Rotating drag adjustment device 86 in the other direction decreases the ease of movement of pedal 51. Increasing the ease of movement of pedal 51 means making pedal 51 easier to move in the one or more than one axes of movement measured by moveable multi-axis position sensor 14. Decreasing the ease of movement of pedal 51 means making pedal 51 more difficult to move in the one or more than one axes of movement measured by moveable multi-axis position sensor 14. Adjusting drag adjustment device 86 changes the ease of movement of pedal 51. In this way foot pedal 50 includes drag adjustment device 86, wherein the ease of movement of pedal portion 51 is changed in response to adjusting drag adjustment device 86.

In some embodiments of music control device 10, moveable multi-axis position sensor 14 is placed some distance from processor 16 and reference multi-axis position sensor 12. In these embodiments moveable multi-axis position sensor 14 communicates through a remote hard-wired connection or a remote wireless connection to processor 16. Electric music control foot pedal 50 of FIG. 9 through FIG. 14 includes jack 128 which accepts hard-wired angular position signal 38 from a remote moveable multi-axis position sensor 14. In this way moveable multi-axis position sensor 14 can be positioned remotely from reference multi-axis position sensor 12. When jack 128 is connected to remote multi-axis position sensor 14, the tilt function of pedal portion 51 is inoperative.

Figure 15:
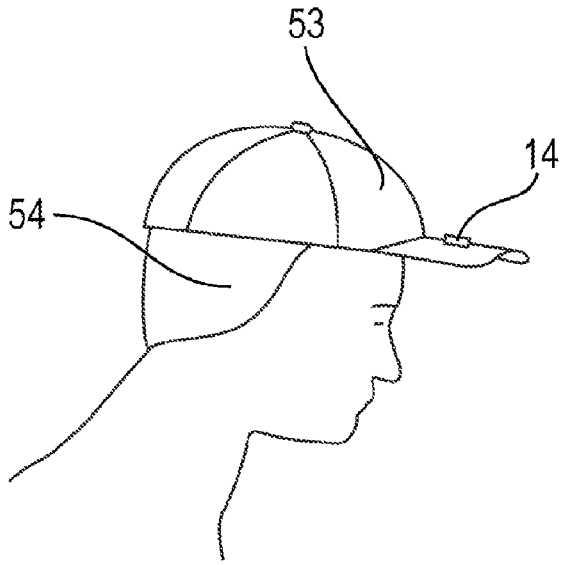
FIG. 15 shows moveable multi-axis position sensor 14 according to the invention removably coupled to the head of a musician.
Figure 16:
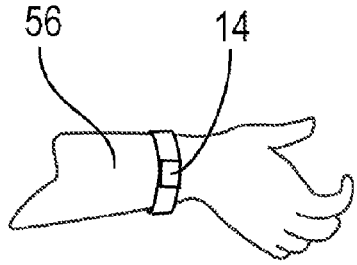
FIG. 16 shows moveable multi-axis position sensor 14 according to the invention removably coupled to the arm of a musician.

FIG. 15 and FIG. 16 illustrate how in some embodiments of electric music control device 10 a remote moveable multi-axis position sensor 14 can be removeably coupled to a moveable appendage of a musician. FIG. 15 shows moveable multi-axis position sensor 14 attached to hat 53 which can be used on a musician's head 54. In this way moveable multi-axis position sensor 14 outputs angular position 38 which represents the angular position of musicians' head 54. FIG. 16 shows moveable multi-axis position sensor 14 attached to arm 56. In this embodiment moveable multi-axis position sensor 14 outputs angular position 38 which represents the angular position of arm 56. In some embodiments moveable multi-axis position sensor 14 can be attached to another appendage. In this way the musician may use his or her appendage to rotate moveable sensor 14 about the axes of rotation to control various music effects. In this way moveable multi-axis position sensor 14 can be removeably coupled to a moveable appendage of musician. In other embodiments, moveable multi-axis position sensor 14 is placed upon a different moveable object, such as, but not limited to, an electric instrument, an instrument strap, and the like.

Figure 17:
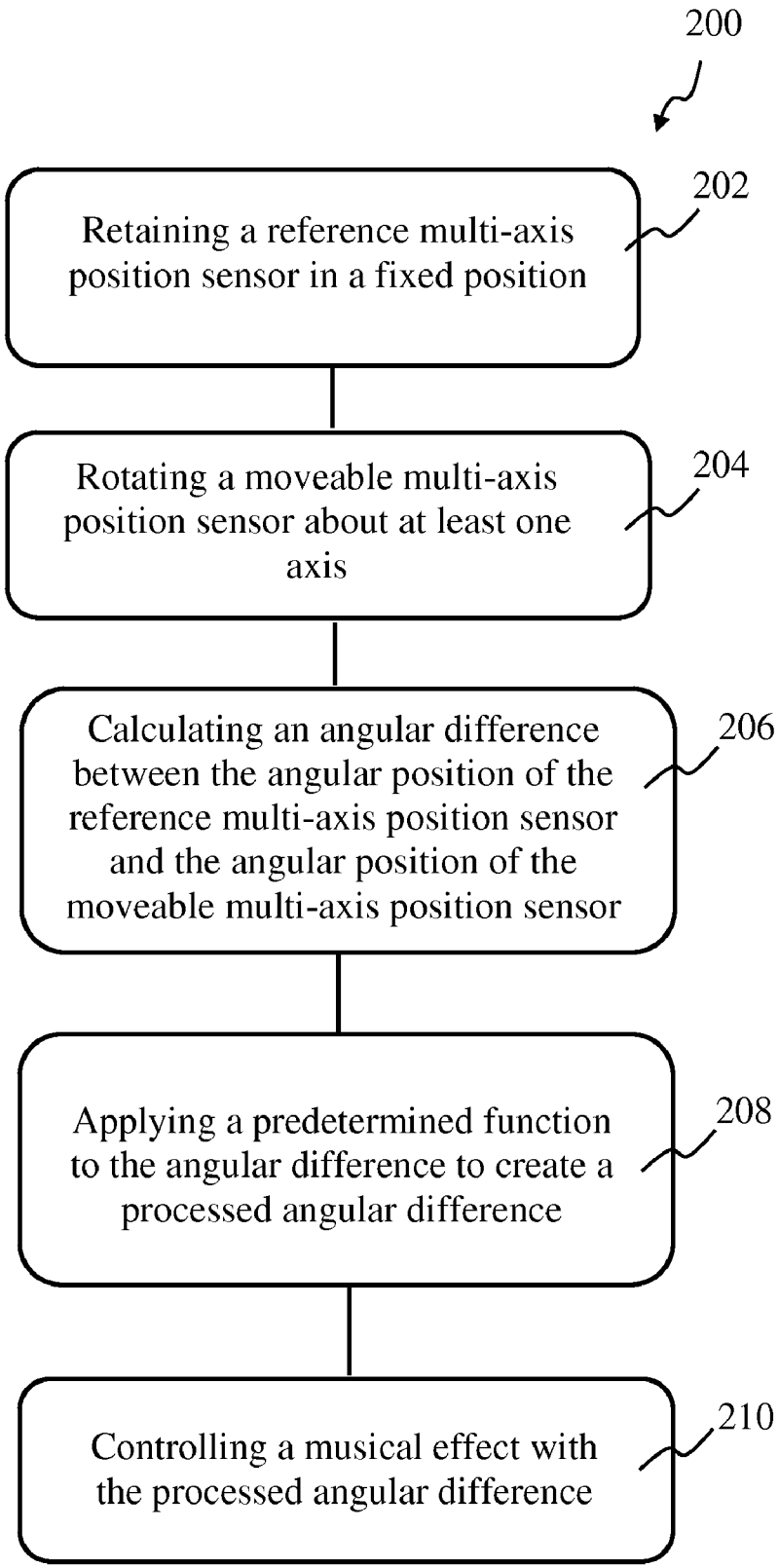
FIG. 17 illustrates method 200 of controlling a musical effect.

A method of controlling a musical effect is disclosed as illustrated in FIG. 17. Method 200 for controlling a musical effect includes step 202, retaining a reference multi-axis position sensor in a fixed position, and step 204, rotating a moveable multi-axis position sensor about at least one axis. Method 200 also includes step 206, calculating an angular difference between the angular position of the reference multi-axis position sensor and the angular position of the moveable multi-axis position sensor. Method 200 includes step 209, applying a predetermined function to the angular difference to create a processed angular difference, and step 210, controlling a musical effect with the processed angular difference. Method 200 can include many other steps. In some embodiments method 200 includes rotating the moveable multi-axis position sensor about more than one axis, and controlling a musical effect with the processed angular difference from each axis. In some embodiments method 200 includes mounting the moveable multi-axis position sensor to a moveable appendage of a musician. In some embodiments method 200 includes mounting the reference multi-axis position sensor in the base portion of a foot pedal. In some embodiments method 200 includes mounting the moveable multi-axis position sensor to the pedal portion of a foot pedal. In some embodiments method 200 includes choosing a predetermined function from a set of predetermined functions stored in a database.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. An electric music control foot pedal comprising:

a base portion;

a pedal portion coupled to the base portion, wherein the pedal portion is allowed to move in at least one axis with respect to the base portion;

a reference multi-axis position sensor mounted in the base portion, the reference multi-axis position sensor having at least one axis held in a fixed position, the at least of axis corresponding to the at least one axis the pedal portion is allowed to move in;

a moveable multi-axis position sensor mounted in the pedal portion, wherein the moveable multi-axis position sensor is rotatable about at least one axis, the at least one axis corresponding to the at least one axis the pedal portion is allowed to move in;

a processor in communication with both the reference multi-axis position sensor and the moveable multi-axis position sensor, wherein the processor creates an angular difference in response to receiving the angular position of the at least one axis of the reference multi-axis position sensor and the angular position of the at least one axis of the moveable multi-axis position sensor; and, wherein the angular difference controls a music effect of an electric instrument; and a drag adjustment device, wherein the ease of movement of the pedal portion is changed in response to adjusting the drag adjustment device.

2. The device of claim 1, further comprising a database, wherein the database stores in a look-up table predetermined functions correlating to a desired music effect.

3. The device of claim 2, wherein the processor applies at least one predetermined function to the angular difference to create a processed angular difference, wherein the processed angular difference controls a music effect of an electric instrument.

4. The device of claim 3 wherein the processor applies a gain function to the angular difference.

5. The device of claim 3 wherein the processor applies a polarity reverse function to the angular difference.

6. The device of claim 1 further including a tension adjustment device, wherein the pedal return time is changed in response to adjusting the tension adjustment device.

7. The device of claim 1, wherein the moveable multi-axis position sensor is rotatable about at least two axes, and wherein rotation about each axis correlates to a different music effect.

8. The device of claim 1, wherein the angular difference controls two different musical effects of an electric instrument.

9. An electric music control foot pedal comprising:

a base portion;

a pedal portion coupled to the base portion, wherein the pedal portion is allowed to move in at least one axis with respect to the base portion;

a reference multi-axis position sensor mounted in the base portion, the reference multi-axis position sensor having at least one axis held in a fixed position, the at least of axis corresponding to the at least one axis the pedal portion is allowed to move in;

a moveable multi-axis position sensor mounted in the pedal portion, wherein the moveable multi-axis position sensor is rotatable about at least one axis, the at least one axis corresponding to the at least one axis the pedal portion is allowed to move in;

a processor in communication with both the reference multi-axis position sensor and the moveable multi-axis position sensor, wherein the processor creates an angular difference in response to receiving the angular position of the at least one axis of the reference multi-axis position sensor and the angular position of the at least one axis of the moveable multi-axis position sensor; and, wherein the angular difference controls a music effect of an electric instrument; and a database, wherein the database stores in a look-up table predetermined functions correlating to a desired music effect; wherein the processor applies at least one predetermined function to the angular difference to create a processed angular difference, wherein the processed angular difference controls a music effect of an electric instrument; and wherein the processor applies a polarity reverse function to the angular difference.

* * * * *